United States Patent [19]

Achelpohl et al.

[11] 4,216,705

[45] Aug. 12, 1980

[54] APPARATUS FOR MAKING CARRIER BAGS FROM TWO HALF-TUBES RUNNING SIDE-BY-SIDE

[75] Inventors: Fritz Achelpohl; Friedhelm Mundus, both of Lengerich, Fed. Rep. of Germany

[73] Assignee: Windmoller & Holscher, Lengerich, Fed. Rep. of Germany

[21] Appl. No.: 940,667

[22] Filed: Sep. 8, 1978

[30] Foreign Application Priority Data

Sep. 30, 1977 [DE] Fed. Rep. of Germany ..... 2744233

[51] Int. Cl.[2] ..... B31B 1/86

[52] U.S. Cl. ..... 93/33 H; 93/35 H

[58] Field of Search ..... 93/33 R, 33 H, 35 H

[56] References Cited

U.S. PATENT DOCUMENTS

| | | | |
|---|---|---|---|
| 2,214,593 | 9/1940 | Mustin et al. | 93/33 R X |
| 4,068,566 | 1/1978 | Joice | 93/33 H X |

FOREIGN PATENT DOCUMENTS

| | | | |
|---|---|---|---|
| 2434761 | 3/1975 | Fed. Rep. of Germany . | |
| 2446007 | 4/1975 | Fed. Rep. of Germany | 93/35 H |
| 2526014 | 12/1976 | Fed. Rep. of Germany . | |

*Primary Examiner*—Robert D. Baldwin

*Attorney, Agent, or Firm*—Fleit & Jacobson

[57] ABSTRACT

Two longitudinally split plastics tubes are fed in parallel by respective feeding means and each have at least one margin folded back to have handle-hole reinforcements applied to it at intervals. The reinforcements are severed from a web by a rotary knife. The handle holes are formed in the tubes by punches simultaneously with the operation of separating welding means for welding off carrier bags from both tubes. Two photocells upstream of the reinforcement applying station scan printed register marks on the tubes and bring the tubes into phase with the rotary knife by operating a respective motor-driven indexing roller for each tube. Two further photocells for scanning the register marks are adapted to stop the feeding means independently when the tubes are correctly positioned in relation to the punches and separating welding means.

7 Claims, 3 Drawing Figures

APPARATUS FOR MAKING CARRIER BAGS FROM TWO HALF-TUBES RUNNING SIDE-BY-SIDE

The invention relates to an apparatus for making carrier bags from preprinted plastics half-tubes running side-by-side in parallel, comprising means for turning and folding back at least one marginal zone of each half tube and applying handle-hole reinforcing strips to the exposed inner marginal zones of the semi-tubular webs and comprising handle hole punches engaging both webs and transverse separating welding means which simultaneously weld off bags from both webs.

DT-OS 24,34,761 discloses an apparatus with the aid of which, for the purpose of making from a web of semi-tubular film carrier bags having reinforced handle hole portions, reinforcing strips can be applied to the inner marginal zones of the web in the region of the subsequent handle holes by temporarily turning back at least one marginal zone. Reinforcing strips are then applied to the thus exposed marginal zones in such a way that, after they are turned back, they are superposed within the semi-tubular web. To finish the carrier bags, the handle holes are then punched in the region of the reinforcing strips and the bags are welded off the semi-tubular web.

In an endeavour to increase the output of this known apparatus, it has already been suggested by DT-OS 25,26,014 to produce carrier bags in duplicate side-by-side on one machine in one operation by continuously cutting open a plastics tube at the centre, temporarily turning over the marginal zones formed by the cut edges, and applying handle-hole reinforcing strips to the turned-over marginal zones as well as the opposed unsevered lower wall of the tubular web. After folding back the marginal zone provided with the handle-hole reinforcing strips, the lower wall of the tube is also cut open centrally and, after the punching of handle hole apertures, two bags are welded off simultaneously from both semi-tubular webs.

In the apparatus known from DT-OS 25,26,014, central cutting open of the lower wall of the tubular web is effected after application of the reinforcing strips only in order to prevent relative displacement between the two previously separated semi-tubular webs which would make it impossible to apply the reinforcing strips accurately. In the method performed by the known machine, therefore, the lower uncut tubular web is to provide cohesion so that displacement is impossible and the handle-hole reinforcing strips can always be applied to the layers of film at a constant spacing.

For reasons of costs, it is desirable to produce carrier bags in a tandem arrangement even if printed half-tubes are to be processed. Half-tubes provided with multicolour printing can be produced more cheaply than full tubes printed in the same way. However, the webs folded into half-tubes may, because of the printing or for some other reasons, exhibit uneven format or repeat lengths and thus there would be errors in size when they are processed in a tandem arrangement to form carrier bags and these errors would make the simultaneous processing of the webs impossible.

It is therefore the problem of the present invention to provide an apparatus of the aforementioned kind for the simultaneous manufacture of carrier bags from two juxtaposed preprinted plastics semi-tubular webs, in which, even with different size or repeat lengths, both webs pass in equal phase through the station for applying the handle hole reinforcing strips as well as the handle hole punch and the transverse separating welding means.

This problem is solved according to the invention in that in front of the severing means simultaneously cutting the handle hole reinforcing strips from a web withdrawn from a supply reel and conveying means feeding same to the semi-tubular webs there are provided two photocell means which scan a printed mark on each web, detect its position relatively to the phase position of the knife shaft and, depending on the departure of the printed marks from the desired position given by the phase position of the knife shaft, momentarily switch on an electric motor which appropriately changes the position of a loop-forming indexing roller associated with each semi-tubular web, and that two further photocell means scanning the printed marks are provided, which independently stop feeding means when the bags to be welded off the webs are correctly positioned under the punching and transverse separating welding tools. By means of the apparatus according to the invention, it is ensured that two bags can be simultaneously cyclically made from two preprinted plastics semi-tubular webs in one machine even if the format lengths of the printing are relatively different on the two semi-tubular webs. The first scanning of the printed marks ensures that the two semi-tubular webs pass in the correct phase through the means for applying the handle hole reinforcing strips so that the handle holes can subsequently be punched through them at the centre. In the case of the indexing roller control for correcting the phase position of the two webs, the desired position need not be prescribed by the phase position of the knife shaft. The desired position can also be determined by other periodically rotating parts of the means for applying the handle hole reinforcing strips.

To ensure that the bags are punched and welded off in correct registry and true to printed length, second photocell means for scanning the printed marks are provided, which separately control the intermittent feeding of the two webs as well as the simultaneous actuation of the punching and transverse separating welding means.

Advantageous embodiments of the invention are described in more detail in the subsidiary claims.

One example of the invention will now be described with reference to the drawing wherein.

Figure 1:
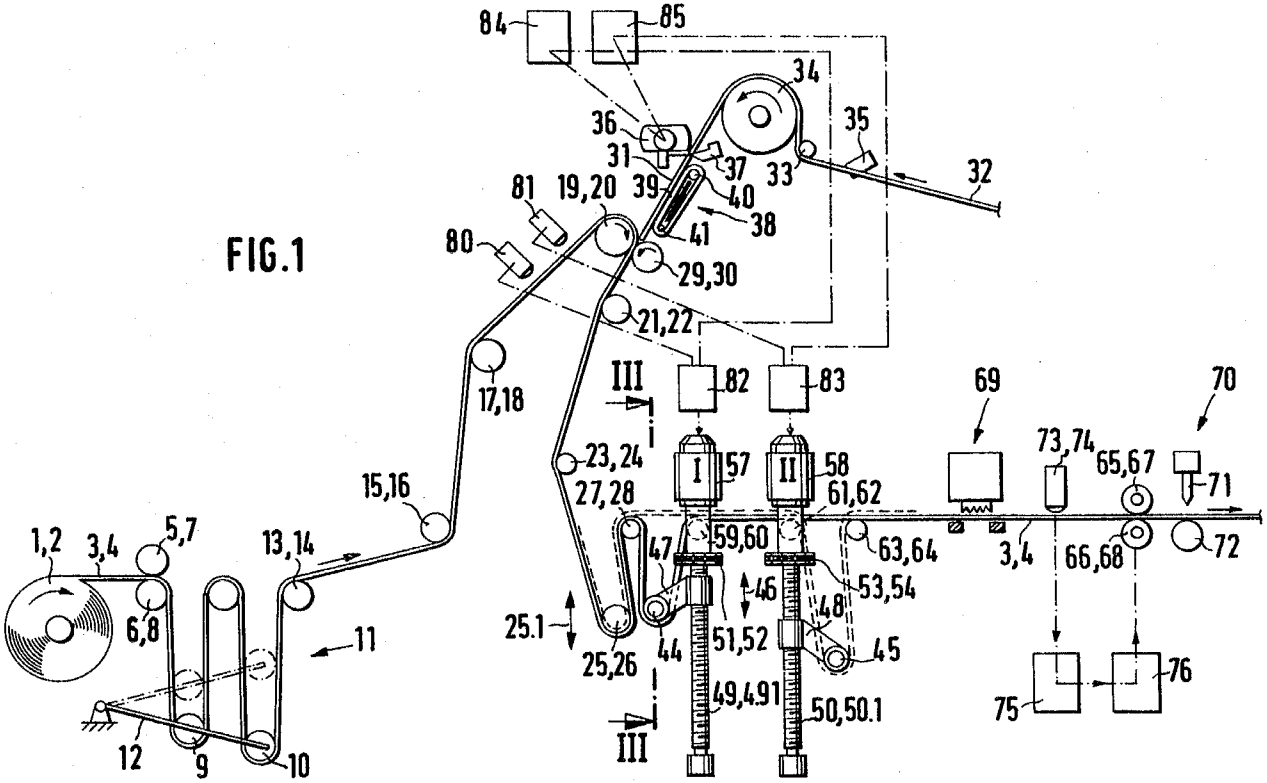
FIG. 1 is a diagrammatic side elevation of the apparatus for making carrier bags from two plastics half-tubes running side-by-side in parallel.
Figure 2:
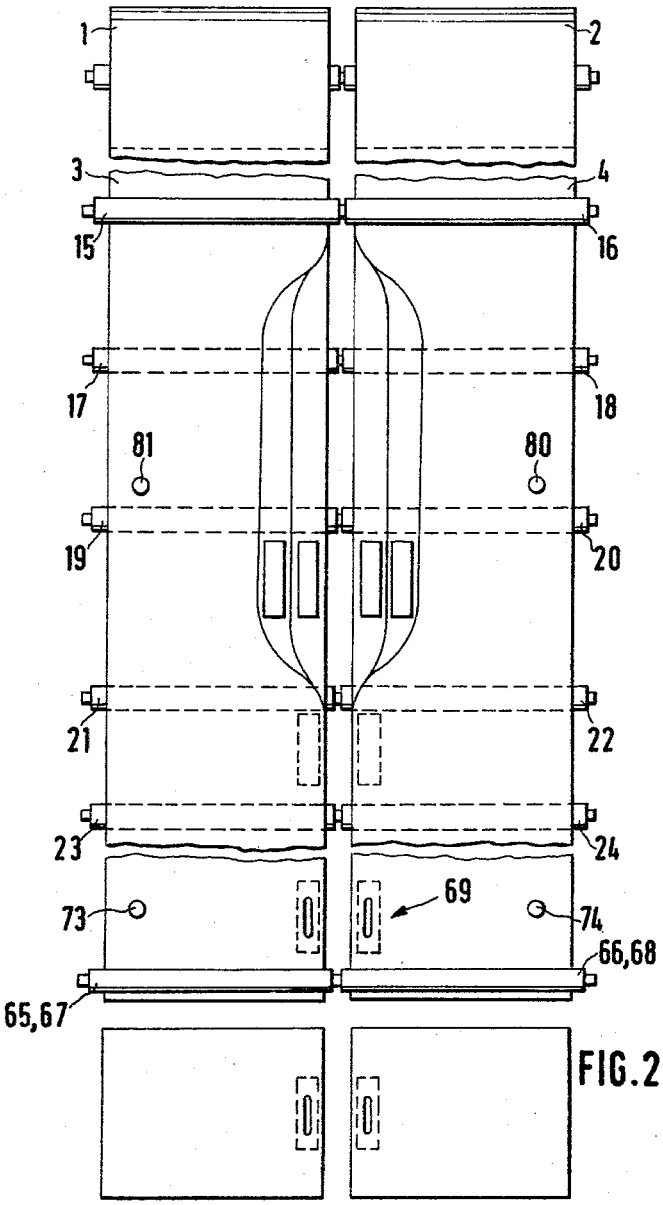
FIG. 2 is a plan view of the plastics half-tubes showing the individual operating stations diagrammatically.
Figure 3:
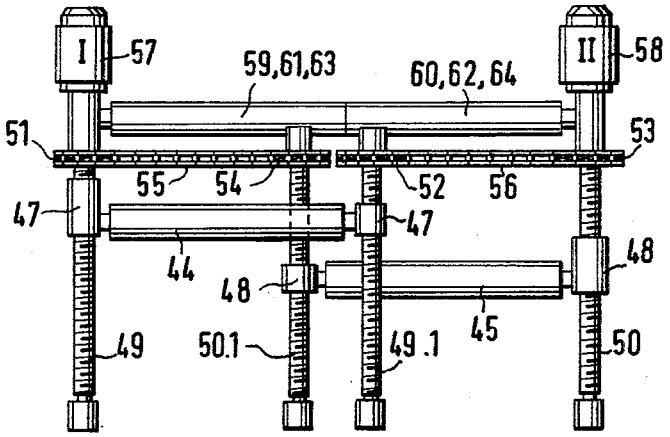
FIG. 3 is a section through the apparatus taken on the line III—III in FIG. 1.

From two coaxially juxtaposed supply reels 1, 2, two flattened preprinted plastics semi-tubular webs 3, 4 are continuously withdrawn each by two coaxial feed roller pairs 5, 6 and 7, 8. Jockey rollers 9, 10 of web tension control means 11 are provided for each half-tube 3, 4. The jockey rollers 9, 10 are freely rotatable on levers 12 which pivot about an axis fixed with respect to the frame. Depending on the departure of the position of the levers 12 from the horizontal, the speeds of the feed roller pairs 5, 6 or 7, 8 are controlled in known manner. The half-tubes 3, 4 are passed over guide rollers 13 to 18 which are rotatably mounted in pairs on common shafts and over feed rollers 19, 20. Folding plates (not shown) disposed between the guide roller pairs 15, 16 and 17, 18 fold the upper tube walls back onto themselves in the region of the subsequent bag mouths. The feed rollers 19, 20 are followed by guide rollers 21 to 28. Folding plates (not shown) between the guide rollers 21, 22 and 23, 24 turn the folded tube walls back again.

Guide rollers 29, 30 co-operating with the feed rollers 19, 20 bring along the pre-glued handle hole reinforcing strips 31 from a glued web 32 and, at the instant of passing through between them and the feed rollers 19, 20, press the strips to the main tubes 3, 4 and connect them thereto. The web 32, which is continuously withdrawn from glueing apparatus (not shown) over a guide roller 33 and through a feeding suction cylinder 34 is cut into four longitudinal strips by knives 35. These strips are perforated transversely by a rotary knife 36 which co-operates with a fixed knife 37. A suction bolt guide 38 consisting of suction belts 39 and rollers 40, 41 is disposed between the rotary knife 36 and the feed rollers 19, 20 or the guide rollers 29, 30. The spacing between the perforating knife 36 and the feeding or guide roller pairs 19, 20 and 29, 30 is about one and a half times the length of the reinforcing strips. After transverse perforation by the rotary knife 36, the reinforcing strips 31 are held by the suction belts 39 and continuously advanced in conformity with their peripheral speed. When the leading end of the reinforcing strips 31 reaches the nip of the rollers 19, 20; 29, 30, they are accelerated to the speed of the half tubes 3, 4 and torn off the web 32 along the transverse perforation.

Downstream of the guide rollers 27, 28, the half tube shown in full lines is fed over an indexing roller 44 and the other half tube shown in broken lines is passed over an indexing roller 45, both indexing rollers 44, 45 being separately adjustable in the direction of the double arrow 46. For this purpose, the indexing rollers 44 or 45 are mounted at their free ends in bearing blocks 47, 48 having tapped holes perpendicular to the bearing holes for the indexing rollers 44 or 45, the tapped holes receiving screw spindles 49 and 49.1 or 50 and 50.1 which are freely rotatable in the frame of the machine but are axially undisplaceable.

Tightly keyed to the screw spindles 49, 49.1 or 50, 50.1 there are sprockets 51 to 54, a chain 55 passing about the sprockets 51 and 52 and a chain 56 about the sprockets 53 and 54.

The screwspindle 49 is rigidly connected to the shaft of the motor 57 and the screw spindle 50 to the shaft of a motor 58. By means of momentary actuation of the motors 57, 58, which are controlled by the photocells 80, 81 in a manner to be described, the guide rollers 44, 45 are raised or lowered so that the loops of web between the guide rollers 27, 44, 59 and the guide rollers 28, 45, 60 are shortened or lengthened in accordance with the scanned error in registration.

To set the registration by hand, loop-forming guide rollers 25, 26 are provided which can be adjusted in the direction of the double arrow 25.1 by means which are not illustrated.

The semi-tubular webs 3, 4 are also passed over guide roller pairs 59, 60; 61, 62 and 63,64 which are mounted at a fixed position with respect to the frame. Provided in the plane of the guide rollers 59 to 64 there are coaxial tension roller pairs 65 to 68 which feed the half tubes 3, 4 and produce the web tension, particularly also in the loops of the web. Punching tools 69 for the handle holes of the subsequent bags are disposed between the guide rollers 63, 64 and the tension roller pairs 65 to 68 and behind the tension roller pairs 65 to 68 there are transverse welding means 70 for welding off the bags from the half tubes by means of a separating welding tool 71 which extends over the width of both half tubes and acts on a backing roller 72.

The tension roller pairs 65 to 68 start in accordance with each operating cycle and pull the half tubes 4, 3 to advance them by one bag width. Thereafter, the handle holes are punched out by the punching tools 69 and, simultaneously with this operation, the finished bags are severed from the half tubes by the separating welding tool 71.

The feeding length of the semi-tubular webs 3, 4 is controlled by photocells 73, 74 of which one is directed onto each semi-tubular web 3, 4 and scans the marks printed thereon. The photocells 73, 74 are electrically connected to an amplifier 75 which controls the clutch and braking means 76. With the aid of the photocell control means 73, 74, 75, 76, the drives for the feed rollers 65, 67 and 66, 68 are independently brought to a stop when the printed marks on the semi-tubular webs 3, 4 pass through, so that the semi-tubular webs 3, 4 come to a standstill at a correct position beneath the punching tools 69 and the separating welding tools 71.

The feed rollers 19, 20 and 29, 30 start to turn intermittently together with the feed rollers 65 to 68. This brings the semi-tubular webs 3, 4 from a standstill to a maximum speed and then they are braked to reach a standstill again. The handle hole reinforcing strips are supplied by the suction belts 39 during the advancing motion of the semi-tubular webs 3, 4 and applied in proper relationship to the printing to the inner marginal zones of the semi-tubular webs 3, 4. The application in the proper position is controlled by the photocells 80, 81.

By means of the photocells 80, 81 disposed in front of the feed rollers 19, 20, the printed marks provided on the semi-tubular webs 3, 4 are scanned and their phase position is checked in relation to the angular position of the knife shaft of the rotary knife 36.

The position of the printed marks on the semi-tubular webs 3, 4 in relation to the phase position of the knife shaft is compared by the contact filters 84, 85. The contact filters 84, 85 are driven by way of gears from the knife shaft so that they turn in synchronism with the knife shaft.

The contact filter itself is provided in known manner with means by which one can set the phase position and the so-called dead zones, i.e. the zones in which there is to be no regulation even though the register mark is moving away. The signals coming from the photocells 80, 81 and the contact filters 84, 85 are detected and compared by control devices 82, 83 which independently momentarily switch on the motors 57, 58 after detecting a register error. The running time of the motors 57, 58 in each case amounts to between about one quarter and one half second.

The contact filters 84, 85 are provided with three channels, the release of the first channel for example ensuring that the motors 57, 58 turn to the right, the second channel ensuring standstill and the third channel ensuring that the motors turn to the left, so that the loops of the semi-tubular webs 3, 4 passing over the guide rollers 44 or 45 can be lengthened or shortened by raising or lowering these rollers. The contacts of the contact filters 84, 85 for channels 1 and 2 prepare for ignition the thyratrons disposed in the control devices 82, 83 for channel 1 and channel 2. When channel 1 is ready for ignition and the printed mark simultaneously passes under the photoscanner, the thyratron for channel 1 is ignited and switches the appropriate motor on by way of a relay. By way of a cancelling contact, the ignited thyratron is extinguished again. If the scanned printed mark falls in the dead zone between the thyratrons ready for ignition, neither thyratron is ignited and no correction is carried out.

If, therefore, the mutual spacing between the printed marks on one half tube 3, 4 is for some reason larger than in the preceding run of half tube, the handle-hole reinforcing strip could no longer be applied centrally of the subsequent handle hole. The larger spacing between printed marks causes a pulse to be given by the relavant photocell 80 or 81 at the instant when the associated contact filter 84 or 85 releases the appropriate channel which allows the motor 57 or 58 to start so that the guide roller 47 or 48 forms a longer loop. During the next cycle more web material is therefore withdrawn so that the next reinforcing strips to be applied are again located centrally of the subsequent handle hole.

Shortening of the spacing between the printed marks of a half tube causes analogous shortening of the loop. If the spacings remain the same, the central channel of the contact filters 84, 85 is released which causes the motors 82 or 83 to stop so that the loop does not change in length. The running time of the motors 57, 58 is controllable in a known manner (not shown).

What is claimed is:

1. Apparatus for making carrier bags from pairs of preprinted plastics half tubes having printed marks thereon, said apparatus comprising:

means for moving the pairs of tubes side-by-side in parallel through said apparatus;

first means for turning and folding back at least one edge of each tube to thereby expose inner marginal zones of each half tube;

second means including a station for applying handle hole reinforcing strips to the exposed inner marginal zones;

handle hole punches for punching holes in portions of both tubes reinforced by the strips;

transverse welding and separating means for simultaneously transversely welding said tubes to thereby form and separate individual bags from both tubes;

said second means including:

means for supporting a web of reinforcing strips;

means including rotating knives for severing individual strips from the web;

means for moving said web from said supporting means to said severing means;

conveying means for conveying severed strips to the station for applying the strips to the tubes;

first photocell means for scanning and for generating first signals representative of printed marks on each of the webs;

means for sensing and for generating second signals representative of phase positions of said knives of said means for severing; and means for comparing said first and said second signals and for generating control signals when the sensed positions of the printed marks on the tubes relative to the phase positions of corresponding ones of said knives exceed predetermined values;

said means for moving including:

loop-forming indexing rollers associated with each half tube and positioned downstream of the station for applying reinforcing strips;

electric motors for independently controlling the positions of each of said indexing rollers, said motors being responsive to respective ones of said control signals so that the positions of the rollers are determined by the relationship between sensed printed marks on the tubes and sensed phase positions of said knives;

feeding means for feeding tubes from said indexing rollers to said transverse welding and separating means; and second photocell means for sensing printed marks on the tubes and for independently stopping said feeding means so that the tubes are correctly positioned with respect to said transverse welding and separating means.

2. Apparatus according to claim 1, further comprising:

first and second bearing blocks for mounting said indexing rollers, each of said blocks having first holes formed therein for receiving free ends of respective ones of said indexing rollers and tapped through holes extending perpendicular to said first holes; and screw spindles received in said tapped holes, said spindles being axially fixed and rotatable by said electric motors to thereby adjust the positions of said indexing rollers.

3. Apparatus according to claim 2, further comprising:

sprockets fixedly keyed to each of said spindles; and first and second chains for interconnecting the sprockets keyed to spindles associated with said first and second blocks, respectively.

4. Apparatus according to claim 3, wherein each of said electric motors has an output shaft, the output shafts being connected to screw spindles associated with respective ones of said blocks.

5. Apparatus according to one of claims 1–4, wherein said first photocell means are positioned upstream of said station for applying strips, wherein said means for sensing phase positions of said knives includes contact filters, and wherein said means for comparing includes amplifier circuits for receiving signals from said first photocell means and from said contact filters, outputs of said amplifier circuits being connected to said motors.

6. Apparatus according to claim 5, further comprising means for manually adjusting said indexing rollers.

7. Apparatus according to one of claims 1–4, further comprising means for manually adjusting said indexing rollers.

* * * * *